US005349361A

United States Patent [19]

Egashira et al.

[11] Patent Number: 5,349,361

[45] Date of Patent: Sep. 20, 1994

[54] THREE-WAVE ANTENNA FOR VEHICLES

[75] Inventors: Yoshimi Egashira; Ryouichi Miyakawa, both of Tokyo, Japan

[73] Assignee: Harada Kogyo Kabushiki Kaisha, Tokyo, Japan

[21] Appl. No.: 124,367

[22] Filed: Sep. 20, 1993

Related U.S. Application Data

[63] Continuation of Ser. No. 593,788, Oct. 5, 1990, abandoned.

[30] Foreign Application Priority Data

Oct. 5, 1989 [JP] Japan ..... 1-261571

[51] Int. Cl.[5] ..... H01Q 1/32; H01Q 1/00

[52] U.S. Cl. ..... 343/715; 343/900; 343/722

[58] Field of Search ..... 343/715, 711, 712, 882, 343/722, 749, 900, 852, 751, 713

[56] References Cited

U.S. PATENT DOCUMENTS

| | | | |
|---|---|---|---|
| 4,115,779 | 9/1978 | Dantzler et al. | 343/882 |
| 4,200,874 | 4/1980 | Harada | 343/749 |
| 4,243,989 | 1/1981 | Piper | 343/882 |
| 4,675,687 | 6/1987 | Elliott | 343/715 |
| 4,916,456 | 4/1990 | Shyu | 343/715 |

FOREIGN PATENT DOCUMENTS

| | | | |
|---|---|---|---|
| 59-193602 | 11/1984 | Japan | 343/711 |
| 0298202 | 4/1990 | Japan | H01Q 1/32 |

*Primary Examiner*—Donald Hajec
*Assistant Examiner*—Hoanganh Le
*Attorney, Agent, or Firm*—Koda and Androlia

[57] ABSTRACT

A vehicle antenna for AM/FM and MT waves including a first antenna element for MT waves vertically mounted on the vehicle roof and a second antenna element for AM/FM waves rotatably coupled to the top end of the first antenna element so that the second antenna element can be set at a desired angle relative to the roof of the vehicle. A trap element for blocking MT waves is installed near the lower end of the second antenna element.

3 Claims, 2 Drawing Sheets

THREE-WAVE ANTENNA FOR VEHICLES

This is a continuation of application Ser. No. 593,788, filed Oct. 5, 1990 now abandoned.

BACKGROUND OF THE INVENTION

1. Filed of Industrial Utilization

The present invention relates to a three-band antenna for use in automobiles, which is capable of receiving AM and FM bands and is also capable of transmitting and receiving MT band.

2. Prior Art

Conventionally, antennas for AM and FM broadcast bands (hereafter called "AM/FM antennas") and antennas for transmitting and receiving an MT band (communications band used for automobile telephones, and hereafter called "MT antennas") are installed separately. However, because of problems in terms of external appearance and difficulty in installation, etc., the development of single three-band antennas has been demanded, and such antennas have now reached the stage of practical use. Examples of this type of antenna are disclosed in Japanese Patent Application Laid-Open (Kokai) Nos. 62-173801 and 62-179202.

The antennas disclosed in these Laid-Open publications are simple rod-form antennas and in a form of telescopic antennas (which are free to extend and retract). In the antennas of this structure, it is possible to use a single antenna for the three bands; however, the antenna involves such problems as follows:

Specifically, in the case of an automobile antenna for AM/FM bands, as shown in FIG. 3, an antenna element 1 is inclined with respect to the top surface of vehicle 2 in order to avoid wind pressure and to avoid contact with obstacles when the vehicle is parked in a garage, etc. Such an inclined antenna is also for the purpose of increasing the reception sensitivity in the FM and AM bands. Since FM waves are horizontally polarized waves or circularly polarized waves, the reception sensitivity improveds by the antenna inclined as described above.

Meanwhile, MT antennas must be non-directional within the horizontal plane. Accordingly, such antennas are installed on the top surface of the vehicle body in a perpendicular position so that the transmission and reception are performed with vertically polarized waves.

As described above, it is desirable that the AM/FM antennas be installed to the top surface of the vehicle in an inclined position and the MT antennas installed in a perpendicular position. Thus, these requirements cannot be satisfied as long as a single rod-form antenna of the type described above is used.

For both AM/FM antennas and MT antennas, it is desirable, from the standpoint of transmission and reception efficiency, that the antenna be installed on the roof of the automobile which is the highest part of automobile above the ground. In Europe, the antennas are commonly mounted on the roof of automobiles in view of design preference.

The object of the present invention is to provide a three-band antenna for use in automobiles which has a sufficiently high reception sensitivity in the AM and FM bands, allows good transmission and reception in the MT band, and has a high transmission and reception efficiency.

SUMMARY OF THE INVENTION

The present invention utilizes the following means in order to solve the problems of the prior art and achieve the above-mentioned object:

First, a first antenna element (e.g., with an electrical length of $\lambda/4$) is installed so that it resonates in the MT band and is perpendicular to the roof of an automobile. A second antenna element is coupled to the top of the first antenna element via a shaft supporting means which is capable of rotating so that the second antenna element resonates in the FM band in cooperation with the first antenna element and also functions in the AM band. A trap element which is used to block MT waves is installed in the area in which the second antenna element and the first antenna element are connected.

With the above-described structure, the present invention functions as follows:

The first antenna element, which is the constituent element of the MT antenna, is mounted to the top surface of the vehicle body in a perpendicular position, and the second antenna element, which is the primary constituent element of the AM/FM antenna, is attached to the top surface of the vehicle body in a position inclined at desired angle with respect to the top surface. As a result, an antenna having a configuration suited to the characteristics of the respective band can be obtained. Since the antenna is constructed as a single antenna, there is no difficulty in installation, etc. Since the antenna is mounted to the roof of the automobile, the efficiency of transmission and reception is high, providing high transmission and reception efficiency with good transmission and reception.

DETAILED DESCRIPTION OF THE INVENTION

Figure 1:
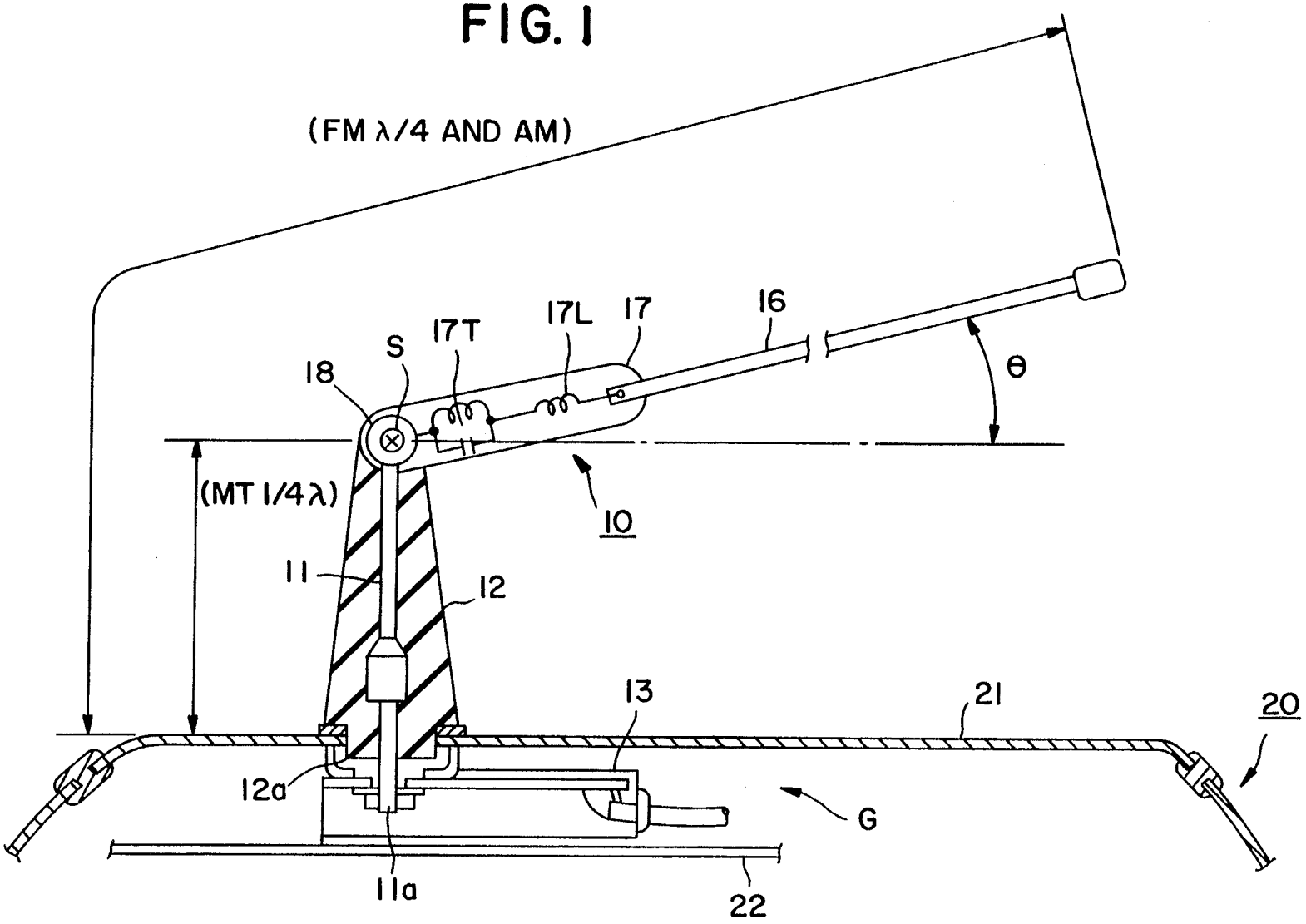
FIG. 1 is a partial cross sectional view of one embodiment of the antenna of the present invention.

FIG. 1 shows a partial cross section of the structure of one embodiment of the present invention. As seen in FIG. 1, the three-band antenna 10 of the present invention is mounted on the roof 21 of an automobile 20.

This three-band antenna 10 is constructed as follows:

A first antenna element 11 with an electrical length of $\lambda/4$ is installed so that it resonates in the MT band e.g., 800 to 900 MHz. The antenna element 11 is mounted to the roof in a perpendicular position, and the circumference of this first antenna element 11 is covered by a protective sleeve 12 which is made of an insulating molding material such as a synthetic resin, etc. The protective sleeve 12, in the form of a circular cone, inhibiting the generation of wind noise, reinforces the mechanical strength of the first antenna element 11. The bottom portion 12*a* of the protective sleeve 12 and base portion 11*a* of the first antenna element 11 are inserted and fixed in an attachment hole which is formed in the roof 21. The base portion 11*a*, which is the feeding point of the first antenna element 11, is connected to a flat-type wave divider 13 which is installed in the narrow space between the roof 21 and the inner lining 22 of the automobile 20.

Figure 2:
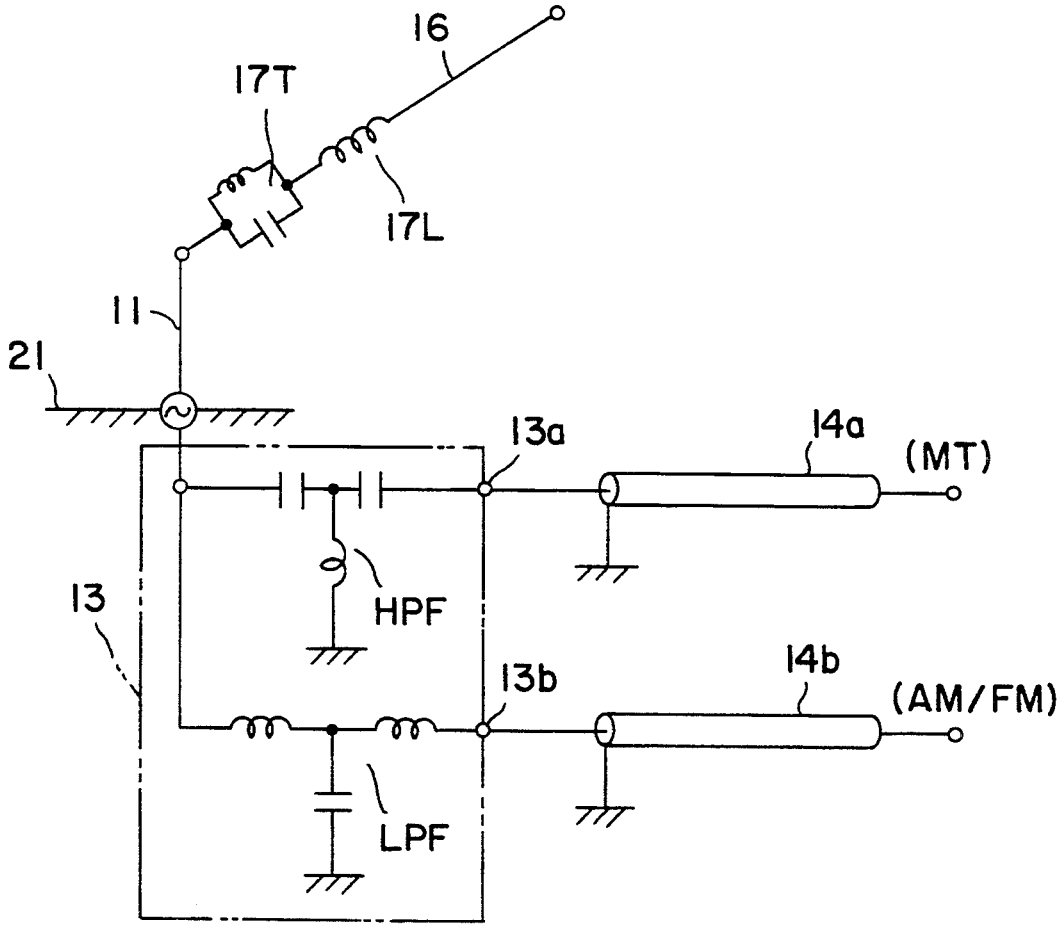
FIG. 2 illustrates the electrical circuitry of the antenna of the embodiment.
Figure 3:
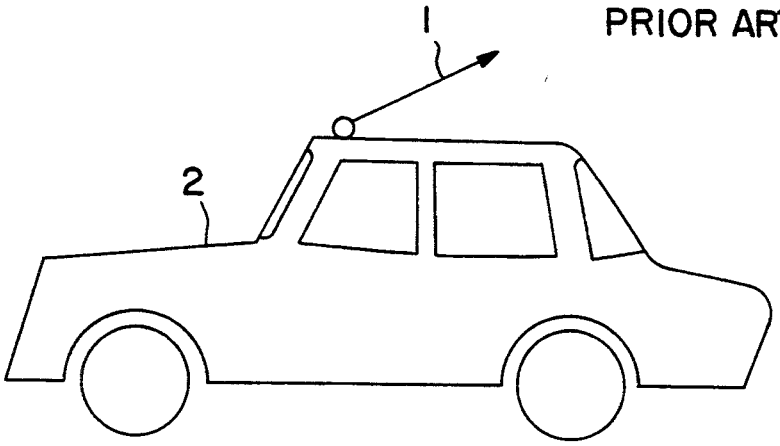
FIG. 3 PRIOR ART
FIG. 3 is an explanatory diagram of prior art.

FIG. 2 shows the electrical circuit of the antenna 10 with the internal construction of the wave divider 13 illustrated primarily. The wave divider 13 comprises a high-pass filter HPF and a low-pass filter LPF and divides AM/FM waves and MT waves through filters. An MT band terminal 13*a* of the wave divider 13 is connected to automobile telephone (not shown) via coaxial cable 14*a*, and an AM/FM band terminal 13*b* of the wave divider 13 is connected to AM/FM receiver (not shown) via coaxial cable 14*b*.

Back to FIG. 1, reference numeral 16 is a second antenna element. This second antenna element 16 is installed so that the sum of the length of the first element 11 and the length of the second element 16 is $\lambda/4$ in terms of electrical length (with respect to the FM band). Thus, the second antenna element 16 resonates in the FM band and also functions in the AM band by acting in conjunction with the first antenna element 11. The base portion 17 of the second antenna element 16 is coupled to the top part of the first antenna element 11 via a shaft supporting assembly 18, which can rotate. The shaft supporting assembly 18 includes, for example, a tightening screw S, and in use the screw S is first loosened, the inclination angle $\theta$ of the second antenna element 16 is adjusted, and then the screw S is tightened back. Thus, the second antenna element 16 can be fixed at such adjusted angle. It is preferable to interpose a spring, etc. so that an appropriate frictional force can act on the shaft supporting portion of the shaft supporting assembly 18.

The base portion 17 of the second antenna element 16 is molded from a hard synthetic resin, etc. Inside the molding are provided a loading coil 17L used for resonance in the FM band and a high-impedance element (e.g., a trap element 17T consisting of L-C parallel circuit as shown in the Figures) which is used to prevent MT waves from entering the second antenna element 16.

With the structure described above, the embodiment functions as follows:

The first antenna element 11, which is the constituent element of the MT antenna, is in a perpendicular position on the top surface of the vehicle body, that is, on the surface of the roof 21. The second antenna element 16, which is the primary constituent element of the AM/FM antenna, is in a position inclined at a desired angle $\theta$ with respect to the surface of the roof 21. Accordingly, an antenna having a configuration suited to the characteristics of the respective bands is formed by the first antenna element 11 and second antenna element 16. Since the antenna is in a single unit, it goes without saying that there is no difficulty in installation, etc. Since the antenna is mounted to the roof 21 of the automobile 20, the efficiency of transmission and reception is high, and good transmission and reception is accomplished.

The present invention is not limited to the embodiment described above. For example, in the above embodiment, since the second antenna element 16 is formed as a short element, the loading coil 17L is used. However, if the element 16 is not formed as a short element, the loading coil 17L is not necessary. Obviously, various other modifications are possible without departing from the spirit of the present invention.

EFFECT OF THE INVENTION

In the present invention, the base portion of the second antenna element (used for the AM/FM band) is coupled via a shaft supporting assembly (which is capable of rotating) to the top part of a first antenna element (used for the MT band) which is installed perpendicularly on the roof of automobile, and a trap element which is used to block MT waves is interposed between the first and second antenna elements. Accordingly, it is possible to obtain a sufficiently high reception sensitivity in the AM and FM bands and good transmission and reception in the MT band with no directionality on a horizontal plane. In addition, since the antenna is installed on the highest part of the automobile above the ground, a three-band antenna for automobile which has a high transmission/reception efficiency can be obtained.

We claim:

1. A three-band antenna for use in automobiles comprising: a first antenna element which is installed perpendicularly on an automobile roof and is $\frac{1}{4}$ wavelength long in telephone frequency band and resonates in the telephone frequency band; a second antenna element with its base coupled to the top part of said first antenna element via a shaft supporting assembly which is capable of rotating, said second antenna element together with said first antenna element being $\frac{1}{4}$ wavelength long in a FM band and resonating in the FM band; and said first and second antenna elements function in the AM radio reception band; and a trap element for blocking said telephone frequency band, said trap element being interposed between said first and second antenna elements.

2. A three-band antenna for use in automobiles according to claim 1 wherein said second antenna element is inclined at an angle with respect to the surface of the automobile roof.

3. A three-band antenna according to claim 2 further comprising a wave divider coupled to said first antenna element for dividing a signal from said three band antenna into AM/FM frequency band and a telephone frequency band.

* * * * *